United States Patent [19]

Hain

[11] Patent Number: 4,822,018

[45] Date of Patent: Apr. 18, 1989

[54] SHEET HANDLING APPARATUS

[75] Inventor: David A. Hain, Monifieth, Scotland

[73] Assignee: NCR Corporation, Dayton, Ohio

[21] Appl. No.: 129,568

[22] Filed: Oct. 27, 1987

[30] Foreign Application Priority Data

Sep. 10, 1987 [GB] United Kingdom ..... 8721261

[51] Int. Cl.[4] ..... B65H 5/22

[52] U.S. Cl. ..... 271/3; 270/60; 271/207; 271/9; 271/184; 271/198; 414/789.9

[58] Field of Search ..... 271/3, 3.1, 9, 145, 271/279, 300, 303–306, 69, 184, 198, 199, 213, 216; 209/534, 551; 270/60; 414/43

[56] References Cited

U.S. PATENT DOCUMENTS

| | | | |
|---|---|---|---|
| 2,278,188 | 3/1942 | Bamford et al. | 270/60 |
| 3,481,464 | 12/1969 | Townsend | 209/534 |
| 3,683,943 | 8/1972 | Decrepy | 271/305 |
| 3,888,267 | 6/1975 | Gautschi | 270/60 |
| 4,168,058 | 9/1979 | Granzow et al. | 271/5 |
| 4,193,685 | 3/1980 | Rudy et al. | 271/3 |
| 4,363,584 | 12/1982 | Kokubo | 414/43 |
| 4,441,704 | 4/1984 | Uchida et al. | 271/303 |
| 4,462,509 | 7/1984 | Adelberger | 221/259 |
| 4,468,021 | 8/1984 | Weber | 270/60 |
| 4,482,057 | 11/1984 | Shawen et al. | 209/534 |
| 4,552,350 | 11/1985 | Nagy et al. | 271/3 |
| 4,578,009 | 3/1986 | Granzow et al. | 414/34 |
| 4,585,144 | 4/1986 | Granzow et al. | 221/7 |
| 4,624,359 | 11/1986 | Gross | 198/366 |
| 4,697,944 | 10/1987 | Peebles et al. | 400/635 |
| 4,699,374 | 10/1987 | Hain | 271/267 |
| 4,747,493 | 5/1988 | Nakanishi | 271/3.1 |

FOREIGN PATENT DOCUMENTS

| | | | |
|---|---|---|---|
| 0194139 | 5/1986 | European Pat. Off. . | |
| 2157379 | 5/1973 | Fed. Rep. of Germany | 271/3 |
| 2054534 | 6/1980 | United Kingdom . | |
| 2142320 | 5/1984 | United Kingdom . | |

*Primary Examiner*—H. Grant Skaggs

*Attorney, Agent, or Firm*—Wilbert Hawk, Jr.; Albert L. Sessler, Jr.

[57] ABSTRACT

A sheet handling apparatus for accumulating currency notes into a stack includes a rotatable cylinder (14), an endless belt (22) driven together with the cylinder (14) and arranged to be in cooperative relationship with the cylinder (14) over a major part of the periphery thereof, and feeding mechanism (98, 84) for feeding currency into an entry throat (174) between the cylinder (14) and the belt (22), whereby a single or multiple note fed into the entry throat (174) is held between the belt (22) and the cylinder (14) and is carried around the axis of the cylinder (14). The operation of the feeding means (98, 84) is synchronized with the rotation of the cylinder (14) so that each successive single or multiple note fed into the entry throat (174) is brought into a superposed relationship with the note or notes already held between the belt (22) and the cylinder (14) so as to form a stack of sheets (24) between the belt (22) and the cylinder (14).

3 Claims, 8 Drawing Sheets

SHEET HANDLING APPARATUS

BACKGROUND OF THE INVENTION

This invention relates to a sheet handling apparatus.

The invention has application, for example, to a currency note stacking mechanism included in a cash dispenser unit of an automated teller machine (ATM). As is well known, in operation of an ATM, a user inserts a customer identifying card into the machine and then enters certain data (such as codes, quantity of currency required, type of transaction, etc.) upon one or more keyboards associated with the machine. The machine will then process the transaction, update the user's account to reflect the current transaction, dispense cash, when requested, from one or more currency cassettes mounted in the machine, and return the card to the user as part of a routine operation.

A cash dispenser unit of an ATM conventionally includes at least one note picking mechanism for extracting notes one by one from a currency cassette, and a stacking and presenting mechanism for accumulating the extracted notes into a stack and then feeding the stack of notes to a delivery port or exit slot in the ATM from where the stack may be removed by a user of the ATM.

A well known type of currency note stacking mechanism includes a stacking wheel which continuously rotates in operation and which incorporates a series of curved tines. Notes are fed one by one to the stacking wheel, and they successively enter between adjacent tines and are carried partly around the axis of the wheel before being stripped from the wheel and formed into a stack. This known stacking mechanism has the disadvantage that problems may arise due to the generation of static electricity.

Another known type of sheet stacking mechanism is disclosed in European Patent Application 0194139. In this known mechanism, sheets, such as currency notes, are accumulated into a stack between two endless belts. For each sheet that is added to the stack, it is necessary for each of the belts to be moved first in one direction and then in the reverse direction, and accordingly this mechanism has the disadvantage that it is slow in operation.

SUMMARY OF THE INVENTION

According to one embodiment of the invention, there is provided a sheet handling apparatus comprising rotatable cylindrical means, endless belt means arranged to be in cooperative relationship with said cylindrical means over a major part of the periphery of said cylindrical means, feeding means for feeding both single and multiple sheets from sheet supply means into an entry throat between said belt means and the periphery of said cylindrical means, drive means, operable in a first mode or a second mode, for driving said belt means and said cylindrical means so that the parts of said belt means and said cylindrical means which are in cooperative relationship with each other move in the same direction, whereby either a single or multiple sheet fed into said entry throat when said drive means is operating in said first mode is carried around the axis of said cylindrical means while held between said belt means and said cylindrical means, the operation of said feeding means being synchronized with the rotation of said cylindrical means so that each successive single or multiple sheet fed into said entry throat while said drive means is operating in said first mode is brought into a superposed relationship with the sheet or sheets already held between said belt means so as to form a stack of sheets between said belt means and said cylindrical means and said cylindrical means, control means for changing the mode of operation of said drive means, whereby, when said drive means changes from said first mode to said second mode of operation, the movement of said belt means and said cylindrical means is reversed so as to drive said stack out of said entry throat and movable guide means associated with said feeding means and being arranged to divert alternate sheets fed from said sheet supply means around a diversion path whereby said alternate sheets are delayed by an amount corresponding to half the time taken for said cylindrical means to complete one revolution.

It is accordingly an the object of the present invention to provide a sheet handling apparatus for accumulating sheets into a stack, which apparatus is reliable in operation and alleviates the disadvantages and problems referred to above experienced with known sheet stacking mechanisms.

BRIEF DESCRIPTION OF THE DRAWINGS

One embodiment of the invention will now be described by way of example with reference to the accompanying drawings, in which.

DETAILED DESCRIPTION

Figure 1:
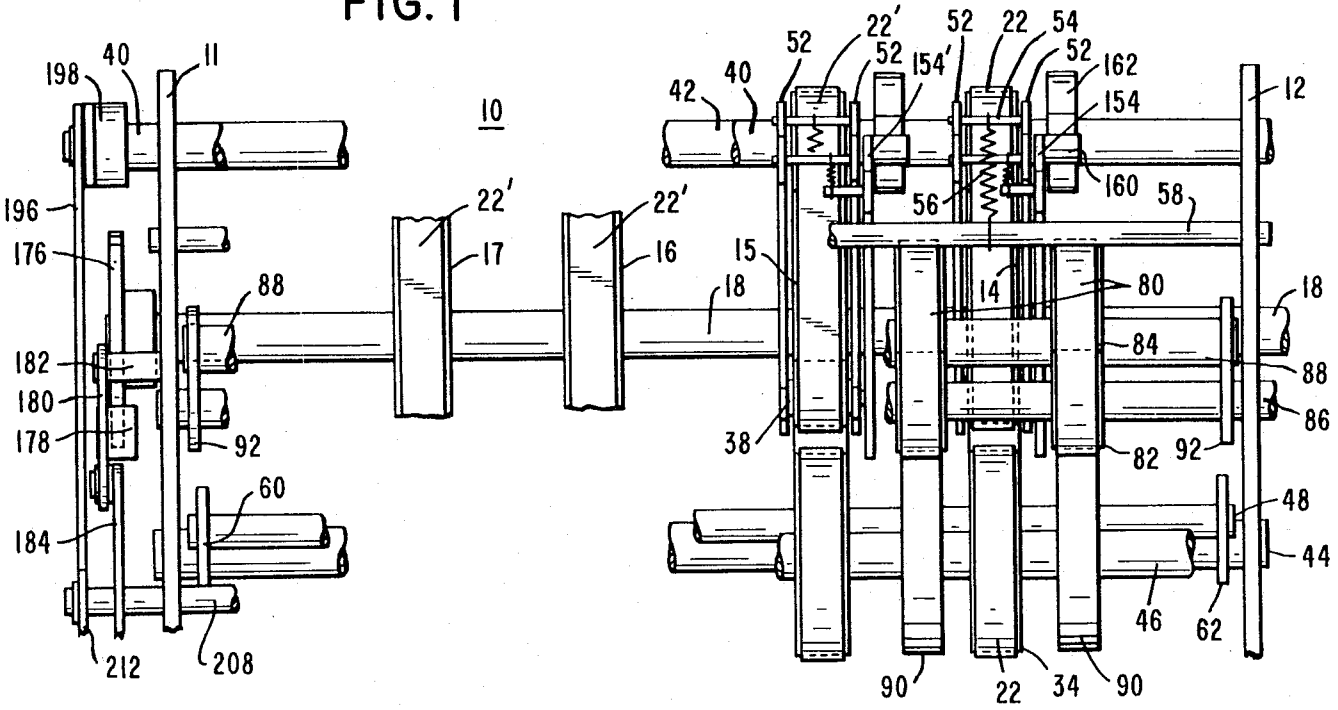
FIG. 1 is a front elevational view of the upper part of a currency note stacking and presenting mechanism in accordance with the present invention.
Figure 2:
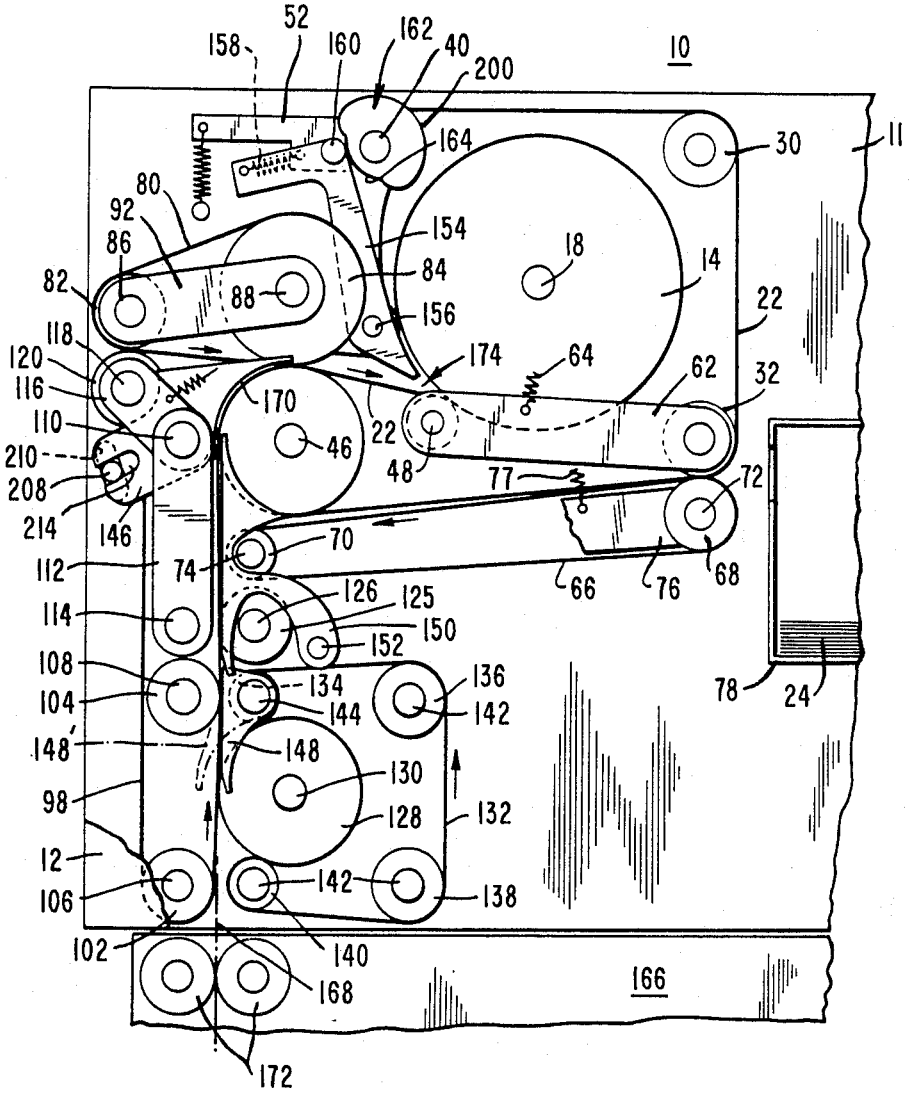
FIG. 2 is a right hand side elevational view on a reduced scale of the stacking and presenting mechanism.

Referring first particularly to FIGS. 1 and 2, the sheet stacking and presenting mechanism 10 shown therein includes a supporting framework having parallel side walls 11 and 12. As seen in FIG. 1, a series of four rotatable steel cylindrical members 14, 15, 16 and 17 are secured on, and spaced apart along, a drive shaft 18 which extends between, and is rotatably mounted with respect to, the side walls 11 and 12. The right hand end (with reference to FIG. 1) of the shaft 18 projects beyond the side wall 12 and is driven via transmission means (not shown) by a reversible electric motor 20

Figure 7:
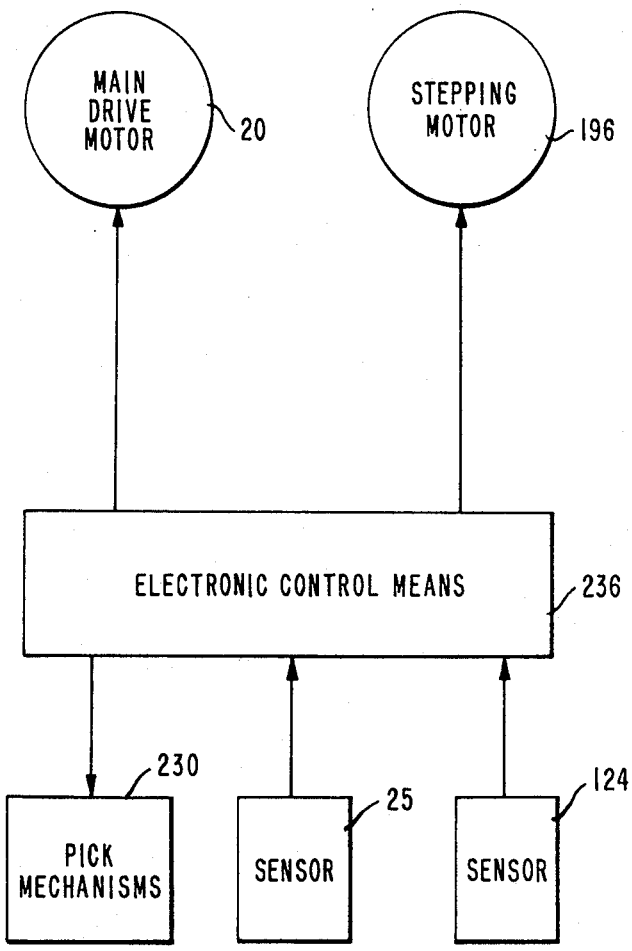
FIG. 7 is a schematic block diagram illustrating the electrical interconnections of parts of the cash dispenser unit.

(FIG. 7). The cylindrical members 14–17, and the mechanisms respectively associated therewith, are all identical, and so only the cylindrical member 14 and its associated mechanism will be described in detail.

Figure 3:
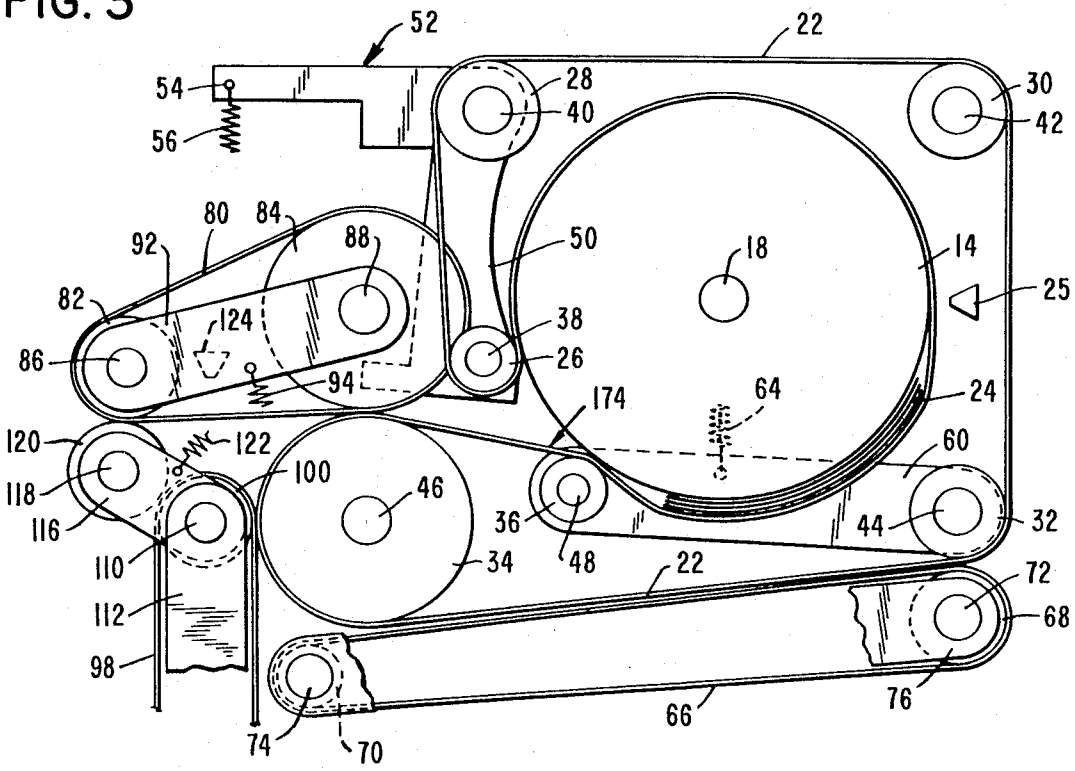
FIG. 3 is a right hand side elevational view of part of the mechanism shown in FIG. 1.

Referring now additionally to FIG. 3, an endless belt 22 of elastomeric material passes partly around the cylindrical member 14 so as to be in cooperative relationship with a major part of the periphery of the member 14. Similarly, an endless stacker belt 22' (FIG. 1) passes partly around each of the other cylindrical members 15–17. As will be explained later, in operation of the sheet stacking and presenting mechanism 10, a stack of currency notes 24 is accumulated between the periphery of the cylindrical member 14 and the belt 22 (and between the peripheries of the cylindrical members 15–17 and the belts 22') as the member 14 rotates in a counterclockwise direction with reference to FIGS. 2 and 3. A sensor 25 senses the leading edge of the stack during each revolution of the member 14 in a counterclockwise direction. The belt 22 is guided around a series of six pulleys 26, 28, 30, 32, 34 and 36 which are respectively mounted on shafts 38, 40, 42, 44, 46 and 48. The shafts 40, 42, 44 and 46 have fixed axes, these shafts passing through, and being supported by, the side walls 11 and 12, with the shaft 46 being driven, together with the shaft 18, by the reversible motor 20 (FIG. 7). For a reason to be explained later, the shaft 40 is rotatably mounted with respect to the side walls 11 and 12 and projects beyond the side wall 11. The shaft 38 extends between, and is supported by, the lower ends of two downwardly projecting arms 50 which respectively form part of two support members 52 pivotally mounted on the shaft 40. A rod 54 connects the support members together, and the assembly of the support members 52, the shaft 38 and the pulley 26 is urged in a counterclockwise direction (with reference to FIGS. 2 and 3) about the axis of the shaft 40 by means of a spring 56 connected between the rod 54 and a fixed rod 58 (FIG. 1) extending between the side walls 11 and 12. By virtue of this arrangement, the pulley 26 is urged towards the periphery of the cylindrical member 14 so as to be maintained in cooperative relationship with respect thereto. It should be understood that each of the cylindrical members 15–17 is also associated with a pair of support members 52 and a shaft 38 arranged to carry a pulley corresponding to the pulley 26. A pair of arms 60 and 62 are respectively positioned adjacent the inner surfaces of the side walls 11 and 12, corresponding ends of the arms 60 and 62 being rotatably mounted on the shaft 44. For the sake of clarity, the arm 62 is not shown in FIG. 3. The shaft 48 extends between, and is supported by, those ends of the arms 60 and 62 remote from the shaft 44. Each of the arms 60 and 62 is urged in a clockwise direction (with reference to FIGS. 2 and 3) about the axis of the shaft 44 by a respective spring 64 connected between the arm 60 or 62 and the adjacent side wall 11 or 12, whereby the pulley 36 is urged towards the periphery of the cylindrical member 14 so as to be maintained in cooperative relationship with respect thereto.

Figure 6:
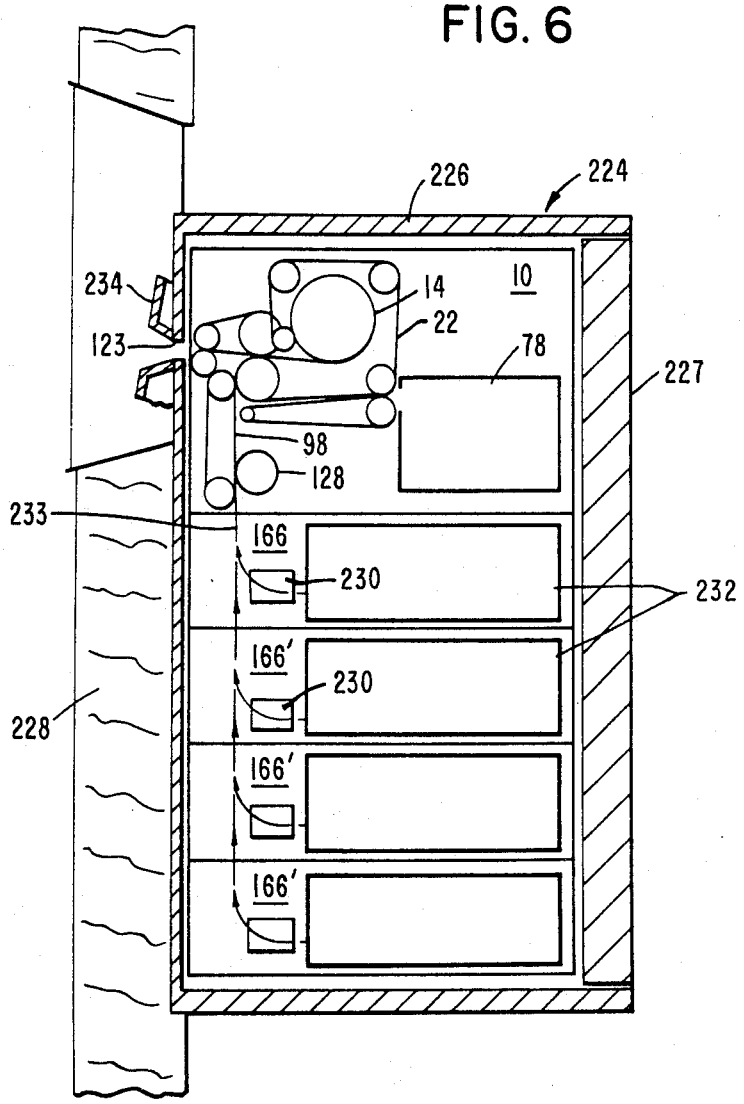
FIG. 6 is a schematic right hand side elevational view of a cash dispenser unit incorporating the stacking and presenting mechanism.

The belt 22 is associated with another endless belt 66 of elastomeric material (not shown in FIG. 1) which is disposed beneath the belt 22 so as to be in cooperative relationship with that length of the belt 22 extending between the pulleys 32 and 34. The belt 66 passes around a pulley 68 and a pulley 70 which are respectively mounted on shafts 72 and 74. The shaft 74 has a fixed axis and it passes through, and is supported by, the side walls 11 and 12, the shaft 74 being driven by the electric motor 20 together with the shafts 18 and 46. A pair of arms 76 are respectively positioned adjacent the inner surfaces of the side walls 11 and 12, and corresponding ends of the arms 76 are rotatably mounted on the shaft 74. The shaft 72 extends between, and is supported by, those ends of the arms 76 remote from the shaft 74. The assembly of the shaft 72 and arms 76 is urged in a counterclockwise direction (with reference to FIGS. 2 and 3) about the axis of the shaft 74 by spring means 77, whereby the belt 66 is maintained in cooperative relationship with the belt 22. As will be explained later, the belt 66 in cooperation with the belt 22 serves to feed a rejected stack of currency notes 24 to a reject hopper 78 (FIGS. 2 and 6).

The sheet stacking and presenting mechanism 10 includes a further series of endless belts 80 of elastomeric material spaced apart between the side walls 11 and 12, with each of the cylindrical members 14–17 being positioned between two of the belts 80. Each belt 80 passes around a pulley 82 and a pulley 84 which are respectively mounted on shafts 86 and 88. The shaft 86 has a fixed axis and it passes through, and is supported by, the side walls 11 and 12, the shaft 86 being driven by the electric motor 20. Each belt 80 is associated with a respective roll 90 (FIG. 1) mounted on the shaft 46. For the sake of clarity, no roll 90 is shown in any of FIGS. 2, 3, 8 and 9, but it should be understood that each roll 90 is positioned in cooperative relationship with the pulley 84 associated with the respective belt 80. A pair of arms 92 are respectively positioned adjacent the inner surfaces of the side walls 11 and 12, and corresponding ends of the arms 92 are rotatably mounted on the shaft 86. The shaft 88 extends between, and is supported by, those ends of the arms 92 remote from the shaft 86. The assembly of the shaft 88 and arms 92 is urged in a clockwise direction (with reference to FIGS. 2 and 3) about the axis of the shaft 86 by spring means 94, whereby each belt 80 is maintained in cooperative relationship with the respective roll 90 (FIG. 1).

The belt 22 is associated with an endless feed belt 98 (not shown in FIG. 1) of elastomeric material which passes around a pulley 100 and a pulley 102, and over a roll 104 positioned between the pulleys 100 and 102. The pulley 102 and roll 104 are respectively mounted on shafts 106 and 108 which have fixed axes and which are both supported by the side walls 11 and 12, the shaft 106 being driven by the motor 20. The pulley 100 is mounted on a shaft 110 carried by a first support structure 112 pivotally mounted on a fixed shaft 114 extending between the side walls 11 and 12. A second support structure 116 is pivotally mounted on the shaft 110, the second support structure 116 carrying a shaft 118 on which are mounted a series of rolls 120 respectively associated with the belts 80. The assembly of the support structures 112 and 116 is urged in a clockwise direction (with reference to FIGS. 2 and 3) about the axis of the shaft 114 by spring means 122 attached to the second support structure 116, whereby the belt 98 is maintained in cooperative relationship with the belt 22 and the rolls 120 are maintained in cooperative relationship with the belts 80. As will be described in more detail later, the belts 80 and the associated rolls 90 (FIG. 1) and 120 serve to feed a stack of currency notes 24 from the cylindrical members 14–17 to a delivery port 123 (FIG. 6). As a stack of notes 24 is fed to the delivery port 123, the leading edge of the stack is sensed by a sensor 124.

As seen in FIG. 2, the belt 98 is associated with roll 125 mounted on a fixed shaft 126 extending between the side walls 11 and 12, and is also associated with a pulley 128 which is secured on a drive shaft 130 which extends between, and is rotatably mounted with respect to, the side walls 11 and 12. An endless belt 132 of elastomeric material passes around a major part of the periphery of the pulley 128 and also passes around four further pulleys 134, 136, 138 and 140. Each of the pulleys 136, 138 and 140 is mounted on a respective fixed shaft 142 extending between the side walls 11 and 12, while the pulley 134 is mounted on a shaft 144 which is rotatably supported by the side walls 11 and 12 and which projects beyond the side walls 11. Movable guide or gate means 146, 148 and 150 are associated with the belt 98. The guide means 146 is pivotally mounted on the shaft 110, the guide means 148 is secured on the shaft 144, and the guide means 150 is secured on a shaft 152 which is rotatably supported by the side walls 11 and 12 and which projects beyond the side wall 11. A movable guide or gate member 154 is attached to one of the support members 52, the guide member 154 being pivotally mounted on a stud 156 secured to the associated support member 52 and being connected to the associated support member 52 by a spring 158. As seen in FIG. 1, the guide member 154 is positioned on one side of the cylindrical member 14. The spring 158 serves to urge the guide member 154 in a clockwise direction (with reference to FIG. 2) about the axis of the stud 156 so as to maintain a follower roll 160 carried on the guide member 154 in engagement with the periphery of a cam 162 which is secured on the shaft 40. Guide members 154', which are similar to and operate in the same way as the guide member 154, are respectively associated with the other cylindrical members 15–17. The normal positions of the guide means 146, 148 and 150 and of the guide member 154 (i.e., the positions when the mechanism 10 is in a non-operating condition) are as shown in solid outline in FIG. 2, the follower roll 160 of the guide member 154 when in this position being in engagement with a low portion 164 of the periphery of the cam 162. It should be understood that, for the sake of clarity, the guide means 146 and 150, the guide member 154 and the cam 162 are not shown in FIG. 3.

Also, it should be understood that further feed belts (not shown) similar to the feed belt 98, are respectively associated with the stacker belts 22' shown in FIG. 1, and that rolls, pulleys and belts similar to the roll 125, pulley 128 and belt 132 are associated with these further feed belts. However, for ease of description, only the feed belt 98 and the mechanism associated therewith will be referred to in the relevant part of the ensuing description. The belt 98 and the associated roll 125 and pulley 128 serve to feed currency notes from a pick module 166 along a feed path 168 to a passageway 170 between the guide means 146 and the belt 22. The currency notes are fed from the pick module 166 to the sheet stacking and presenting mechanism 10 by feed rolls 172, and the notes are guided between the guide means 148 and 150 (when in their normal positions) and the belt 98 to the passageway 170. The purpose of the endless belt 132 will be explained later. From the passageway 170, the currency notes 24 are fed by the belts 80 and associated rolls 90 (FIG. 1) into an entry throat 174 between the cylindrical member 14 and the belt 22 (and between each of the other cylindrical members 15–17 and the associated belts 22').

Figure 4:
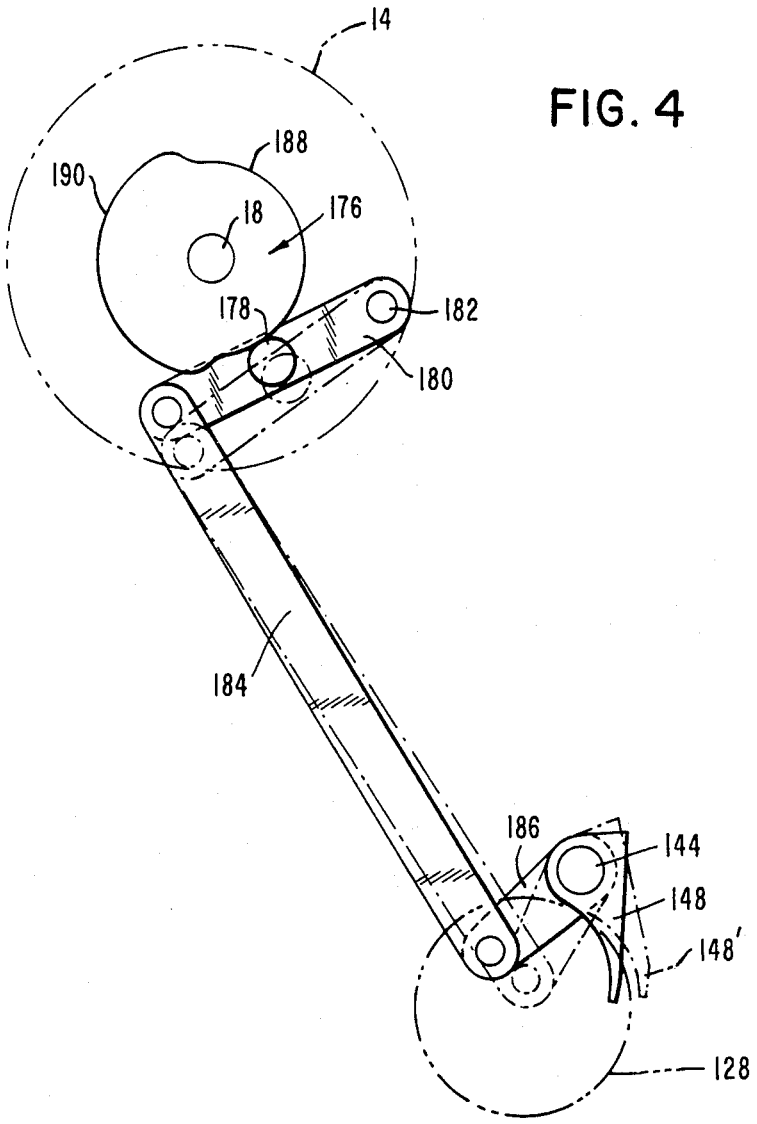
FIG. 4 is a left hand side elevational view of a mechanism for controlling the operation of guide means included in the stacking and presenting mechanism.

Referring particularly to FIGS. 1 and 4, the mechanism for bringing about movement of the guide means 148 between the positions shown in solid and chain outline in FIG. 2 will now be described. A cam 176 is secured on that part of the drive shaft 18 projecting beyond the side wall 11. The cam 176 engages with a follower roll 178 carried on an arm 180 one end of which is pivotally mounted on a stud 182 secured to the side wall 11. The end of the arm 180 remote from the stud 182 is connected via a link 184 to one end of an arm 186 the other end of which is secured on the shaft 144 (see also FIG. 2). Spring means (not shown) maintain the follower roll 178 in engagement with the cam 176. When the follower roll 178 is in engagement with a low region 188 of the periphery of the cam 176, the guide means 148 is in the position shown in solid outline in FIGS. 2 and 4, in which position the guide means 148 guides currency notes along the feed path 168 to the passageway 170 as previously mentioned. When the follower roll 178 is in engagement with a high region 190 of the cam 176, the guide means 148 is in the position 148' shown in chain outline in FIGS. 2 and 4, in which position the guide means 148 diverts a currency note fed to the stacking and presenting mechanism 10 by the feed rolls 172 along a diversion path around the pulley 128. While moving along the diversion path, the note is held between the belt 132 and the periphery of the pulley 128. The pulley 128 has a diameter equal to half that of the cylindrical member 14, and the arrangement is such that by the time a diverted currency note has returned into engagement with the feed belt 98 the guide means 148 has returned to the position shown in solid outline in FIGS. 2 and 4.

Figure 5:
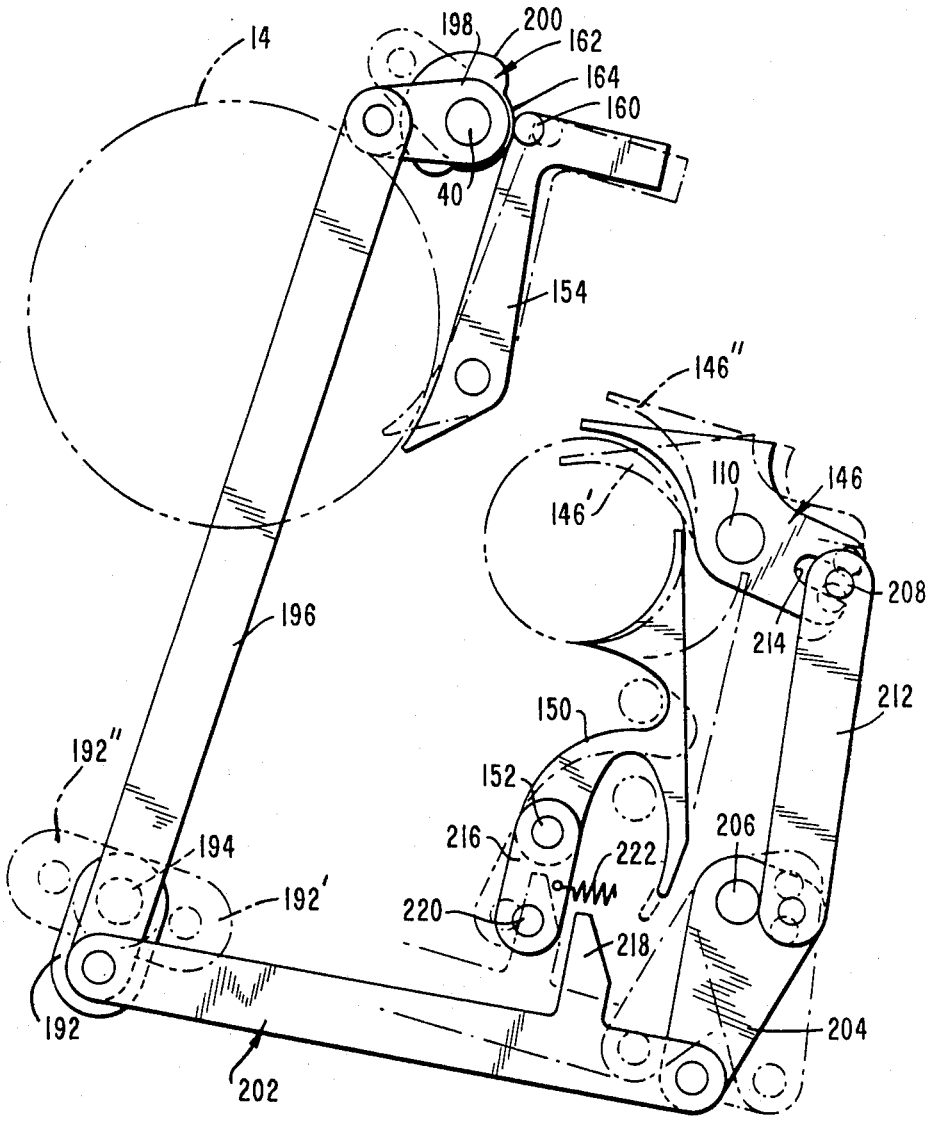
FIG. 5 is a left hand side elevational view of a mechanism for controlling the operation of other guide means included in the stacking and presenting mechanism.

Referring particularly in FIGS. 1 and 5, the mechanisms for bringing about movement of the guide means 146 and 150 and of the guide member 154 will now be described. One end of an arm 192 is secured on a drive shaft 194 which is connected via transmission means (not shown) to a reversible stepping motor 196 (FIG. 7). The arm 192 is rotatable by the motor 196 in a counterclockwise direction (with reference to FIG. 5) from a central position shown in solid outline in FIG. 5 to a first alternative position 192' shown in chain outline, and is also rotatable by the motor 196 in a clockwise direction from its central position to a second alternative position 192" shown in chain outline. The end of the arm 192 remote from the drive shaft 194 is connected via a link 196 to one end of an arm 198 the other end of which is secured on that part of the shaft 40 projecting beyond the side wall 11. When the arm 192 is in its central position, the follower roll 160 (see also FIG. 2) carried by the guide member 154 is in engagement with the low region 164 of the periphery of the cam 162 so that the guide member 154 is in its normal position as shown in FIG. 2 and as shown in solid outline in FIG. 5. When the arm 192 is in either of its alternative positions 192' and 192", the follower roll 160 is in engagement with a high region 200 of the periphery of the cam 162; with the roll 160 in this position, the guide member 154 is in an actuated position as shown in chain outline in FIG. 5.

That end of the arm 192 remote from the drive shaft 194 is also connected via a link 202 to an end portion of an arm 204. A portion of the arm 204 remote from the link 202 is secured on a shaft 206 which passes through, and is rotatably supported by, the side walls 11 and 12. A rod 208 passes through slots 210 (see FIG. 2) respectively formed in the side walls 11 and 12. The end of the rod 208 projecting beyond the side wall 11 is connected via a link 212 to a portion of the arm 204 spaced from the shaft 206. The end of the rod 208 projecting beyond the side wall 12 is connected via connecting means (not shown) to an end portion of the shaft 206 projecting beyond the side wall 12. The rod 208 engages in a slot 214 formed in the guide means 146. By virtue of the linkage formed by the link 202, the arm 204, the link 212 and the rod 208, the guide means 146 is in a central position as shown in FIG. 2 and as shown in solid outline in FIG. 5 when the arm 192 is in its central position, and is in a first alternative position 146' or a second alternative position 146'' as shown in chain outline in FIG. 5 when the arm 192 is in its first alternative position 192' or its second alternative position 192'', respectively.

An arm 216 is secured at one end on that end of the shaft 152 (see also FIG. 2) projecting beyond the side wall 11, and a projection 218 formed on the link 202 is adapted to engage with a stud 220 carried on a portion of the arm 216 remote from the shaft 152. When the arm 192 is in its central position or in its first alternative position 192', the projection 218 is out of engagement with the stud 220, and the guide means 150 is held by spring means 222 in its normal position as shown in FIG. 2 and as shown in solid outline in FIG. 5. When the arm 192 is rotated from is central position to its second alternative position 192'', the projection 218 engages the stud 220 so as to bring about a clockwise rotation (with reference to FIG. 5) of the assembly of the arm 216, shaft 152 and guide means 150 about the axis of the shaft 152, and thereby move the guide means 150 to an actuated position as shown in chain outline in FIG. 5.

Referring now to FIG. 6, the note stacking and presenting mechanism 10 forms part of a cash dispenser unit 224 of a through-the-wall ATM. The mechanism 10, the pick module 166 and additional pick modules 166' are housed in a safe 226, having a rear door 227, mounted in juxtaposition with an outer wall 228 of a bank or other building. Each of the pick modules 166, 166' includes a conventional pick mechanism 230 arranged to pick currency notes one by one from an associated currency cassette 232, and arranged to feed each note picked from the associated cassette along a common feed path 233 to the feed means including the belt 98 of the mechanism 10. Notes picked from one or more of the cassettes 232 are stacked by the mechanism 10 in a manner to be described later, and are then presented to a user of the ATM via the delivery port 123 formed in a user console 234 of the ATM. Alternatively, if notes are rejected for any reason they are diverted to the reject hopper 78. The cash dispenser unit 224 includes electronic control means 236 (FIG. 7) which controls the operation of the main drive motor 20, the stepping motor 196 and the pick mechanisms 230, and to which outputs of the sensors 25 and 124 are applied. It should be understood that the main drive motor 20 operates the drive shafts 18, 46, 74, 86, 106 and 130, the feed rolls 172 and the pick mechanisms 230.

Figure 8:
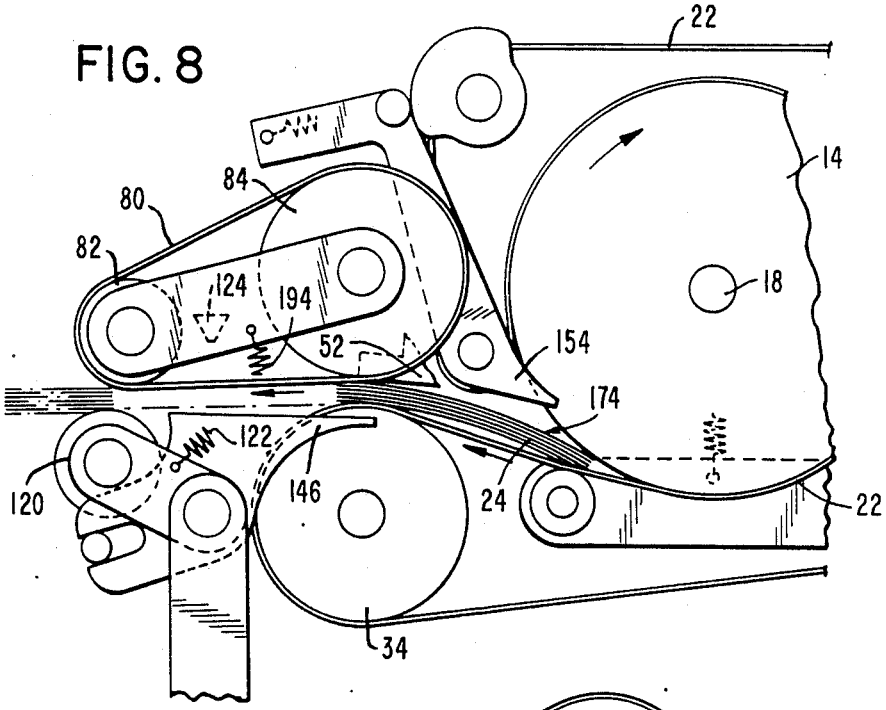
FIG. 8 is a right hand side elevational view of part of the stacking and presenting mechanism showing the mechanism in a currency presenting mode of operation.
Figure 9:
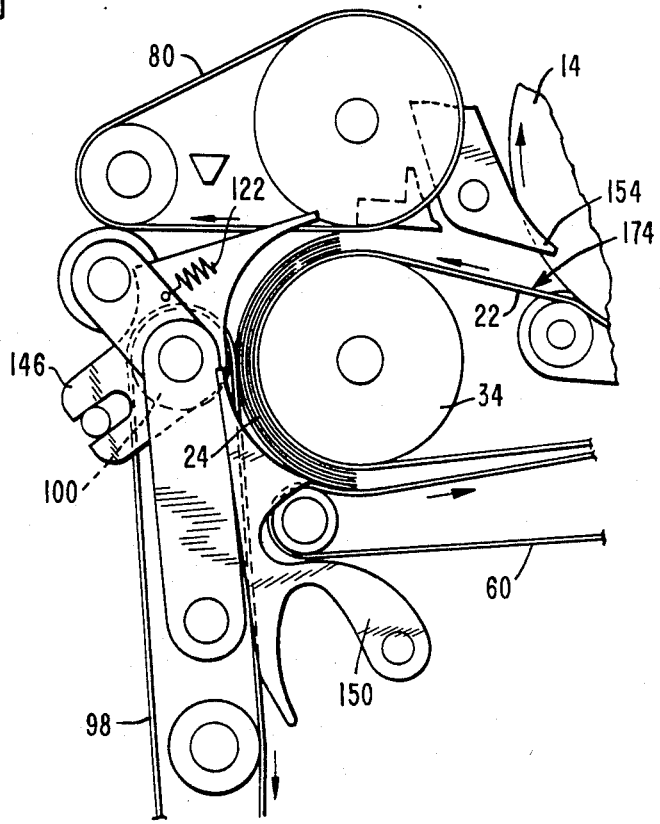
FIG. 9 is a right hand side elevational view of part of the stacking and presenting mechanism showing the mechanism in a currency rejecting mode of operation.

The operation of the cash dispenser unit 224, and particularly the operation of the stacking and presenting mechanism 10, will now be described with additional reference to FIGS. 8 and 9. Immediately prior to a cash dispensing operation being initiated, the main drive motor 20 is in a deactivated condition, and the guide means 146, 148 and 150 and the guide member 154 are in the positions shown in solid outline in FIG. 2. A cash dispensing operation is initiated by a user inserting a customer identifying card into a card entry slot (not shown) in the user console 234 (FIG. 6) and entering appropriate data upon keyboard means (not shown) also included in the user console 234. As a result of this operation being initiated, the main drive motor 20 is activated by the control means 236 so as to cause the assembly of the drive shaft 18 and the cylindrical members 14–17 to rotate in a counterclockwise direction with reference to FIGS. 2 and 3. Still with reference to FIGS. 2 and 3, activation of the motor 20 causes the drive shafts 46 and 130 to rotate in a clockwise direction and the drive shafts 74, 86 and 106 to rotate in a counterclockwise direction so as to cause the endless belts 22, 66, 80, 98 and 132 to move in the directions indicated by the arrows in FIG. 2. After the cylindrical members 14–17 and the belts 22, 66, 80, 98 and 132 have reached a steady operating state, the first currency note is picked from a selected one of the cassettes 232 by the relevant pick mechanism 230 and is fed along the feed path 233 to the stacking and presenting mechanism 10. Upon reaching the mechanism 10, this first note is fed by the belt 98 and cooperating pulley 128 and roll 125 so as to follow a path between the belt 98 and the guide means 148 and 150 and then through the passageway 170 until the leading edge (which is one of the long edges) of the note is gripped between the belts 80 and rolls 90 (FIG. 1). The leading edge of the note is then fed into the entry throat 174 between the belt 22 and the cylindrical member 14, and thereafter the note commences to be carried in a circular path around the axis of the shaft 18 while gripped between the periphery of the cylindrical member 14 and the belt 22 (and between the peripheries of the cylindrical members 15–17 and the belts 22').

Shortly after the first currency note has been fed to the mechanism 10, a second note is picked from the selected cassette 232 and is fed to the mechanism 10 along the feed path 233. The electronic control means 236 controls the operation of the pick mechanisms 230 in synchronism with the rotation of the cylindrical members 14–17 in such a manner that the time ($T_1$) between the leading edges of successive notes reaching the mechanism 10 is equal to half the time ($T_2$) taken for the assembly of the shaft 18 and the cylindrical members 14–17 to complete one revolution. As previously mentioned and as shown in FIG. 3, in the course of the operation of the sheet stacking and presenting mechanism 10, a stack of currency notes 24 is accumulated between the peripheries of the cylindrical members 14–17 and the belts 22, 22'. It is required that corresponding long edges of the notes 24 in the stack should be in substantial alignment, and in order to achieve this it is necessary that each note reaches a point in the entry throat 174 at the same time as the leading edge of any note or stack of notes already being carried around the cylindrical members 14–17 reaches this point. It will be appreciated, therefore, that after reaching the stacking and presenting mechanism 10 the second note 24 must be delayed by a time equal to $T_2/2$. This required delay is brought about as follows. Prior to the second note reaching the guide means 148, this guide means has been moved to the position 148' shown in FIG. 2 by virtue of the follower roll 178 (FIG. 4) having come into engagement with the high region 190 of the cam 176. Accordingly, the second note is diverted so as to follow a circular diversion path around the axis of the shaft 130, this note being held between the belt 132 and the periphery of the pulley 128. As previously mentioned, the diameter of the pulley 128 is half that of the cylindrical member 14 and so the time taken for the leading edge of the second note to complete one circuit of the just-mentioned circular path is equal to $T_2/2$. By the time the leading edge of the second note again engages with the belt 98, the guide means 148 has moved back to the position shown in solid outline in FIG. 2 (by virtue of the follower roll 178 having again come into engagement with the low region 188 of the cam 176), and the leading edge of the third note fed to the mechanism 10 from the selected cassette 232 has reached a position along the feed path 168 in which it is aligned with the leading edge of the second note. Thereafter, the second and third notes are fed together between the guide means 150 and the belt 98 and through the passageway 170 to the entry throat 174. By the time the aligned leading edges of the second and third notes enter the entry throat 174, the first note has completed one circuit of the circular path around the axis of the shaft 18, so that the leading edges of the first, second and third notes are now all aligned. These three notes then travel together as a stack of notes 24 around said circular path, held between the belts 22, 22' and the peripheries of the cylindrical members 14–17 as shown in FIG. 3. Thereafter, each even numbered note (i.e., the 4th, 6th, 8th note etc.) from the selected cassette 232 is delayed by a time $T_2/2$ while traveling to the entry throat 174 compared with each odd numbered note, so that gradually a stack of superposed notes 24 having aligned edges is accumulated between the belts 22, 22' and the peripheries of the cylindrical members 14–17. It will be appreciated that, since the pulleys 26 and 36 (FIG. 3) are resiliently mounted relative to the cylindrical member 14, the pulleys 26 and 36 will be moved away from the cylindrical member 14 against the action of the spring means 56 and 64 as the stack of notes 24 passes between the pulleys 26 and 36 and the cylindrical member 14. Pulleys corresponding to the pulleys 26 and 36 and associated with each of the cylindrical members 15–17 are resiliently mounted in a similar manner to the pulleys 26 and 36. It should be understood that, by virtue of the odd numbered notes being delayed by a time $T_2/2$ while traveling to the entry throat 174, notes can be picked from the selected cassette 232 at a rate twice the picking rate which could have been employed if such delaying technique were not utilized. However, if desired, the diversion path could be omitted, provided that the picking rate is reduced appropriately, and in this case currency notes would be fed one by one to the entry throat 174.

When the required number of currency notes 24 has been accumulated in the manner just described, the electronic control means 236, acting under the control of the sensor 25, deactivates the main drive motor 20 so as to stop the stack of notes 24 held between the bels 22, 22' and the cylindrical members 14–17 in a predetermined position relative to the sensor 25. In this predetermined position, the stack of notes 24 is spaced from the guide members 154, 154' so as not to interfere with movement of the members 154, 154'. Assuming that none of the notes 24 in the stack have been rejected for any reason, the stack is then fed to the delivery port 123 in the user console 234 in a manner which will now be described with particular reference to FIG. 8. Firstly, with the main drive motor 20 still deactivated, the electronic control means 236 causes the stepping motor 196 to move the arm 192 (FIG. 5) to the first alternative position 192'. The movement of the arm 192 to the position 192' causes the guide means 146 and the guide members 154, 154' to be moved to the positions shown in FIG. 8. After the guide means 146 and guide members 154, 154' have been moved to these positions, the electronic control means 236 operates the main drive motor 20 in a reverse sense (as compared with the operating mode during a note stacking operation) so as to bring about reverse movement of the cylindrical member 14 and of the belts 22 and 80 in the directions of the arrows shown in FIG. 8. The reverse movement of the cylindrical member 14 and belt 22 (and corresponding movement of the cylindrical members 15–17 and belts 22') moves the stack of notes 24 out of the entry throat 174, the guide members 154, 154' guiding the left hand edge (with reference to FIG. 8) of the stack of notes 24 away from cylindrical member 14, and the guide means 146 guiding this edge away from the belt 22 and the pulley 34. Thereafter, the belts 80 and cooperating rolls 90 (FIG. 1) and 120 feed the stack of notes 24 towards the delivery port 123 (FIG. 6). It will be appreciated that, since the pulleys 84 are resiliently mounted relative to the rolls 90, and the rolls 120 are resiliently mounted relative to the pulleys 82, the pulleys 84 will be moved away from the rolls 90 against the action of the spring means 94 as the stack of notes 34 passes between the pulleys 84 and rolls 90, and the rolls 120 will be moved away from the pulleys 82 against the action of the spring means 122 as the stack passes between the pulleys 82 and rolls 120. During the movement of the stack of notes 24 towards the delivery port 123, the sensor 124 senses the leading edge of the stack. A predetermined time after the leading edge of the stack of notes 24 is sensed by the sensor 124, the electronic control means 236 deactivates the main drive motor 20 so as to stop the stack in a delivery position in which part of the stack projects through the delivery port 123 and part of the stack is held between the belts 80 and the corresponding rolls 120. After being fed to the delivery position, the stack of notes 24 can be readily removed from the user console 234 by the user of the ATM.

If for any reason it is determined that a stack of notes 24 accumulated between the belts 22, 22' and the cylindrical members 14–17 is to be rejected, for example, as a result of conventional multiple note detect means (not shown) having detected in the course of the stacking operation that two or more notes have been picked from the selected cassette 232 in a single pick operation, the stack of notes 24 is fed to the reject hopper 78 in a manner which will now be described with particular reference to FIG. 9. After the stack of notes 24 has been brought to a stop in the previously mentioned predetermined position relative to the sensor 25, as a result of deactivation of the main drive motor 20, then, with the motor 20 still deactivated, the electronic control means 236 causes the stepping motor 196 to move the arm 192 (FIG. 5) to the second alternative position 192''. The movement of the arm 192 to the position 192'' causes the guide means 146 and 150 and the guide members 154, 154' to be moved to the positions shown in FIG. 9. After the guide means 146 and 150 and the guide members 154, 154' have been moved to these positions, the electronic control means 236 operates the main drive motor 20 in a reverse sense so as to bring about reverse movement of the cylindrical member 14 and of the belts 22, 60, 80 and 98 in the directions of the arrows shown in FIG. 9. The reverse movement of the cylindrical member 14 and belt 22 (and corresponding movement of the cylindrical members 15–17 and belts 22') moves the stack of notes 24 out of the entry throat 174, the guide members 154, 154' guiding the leading edge of the stack of notes 24 away from the cylindrical member 14. Next, the guide means 146 diverts the leading edge of the stack of notes 24 away from the belts 80 and into engagement with the belt 98, after which the leading edge is diverted by the guide means 150 into engagement with the belt 60 as shown in FIG. 9. Thereafter, the stack of notes 24 is fed by the belts 22 and 60 into the reject hopper 78. It will be appreciated that, since the pulley 100 is resiliently mounted relative to the pulley 34, and the pulley 68 (FIG. 2) is resiliently mounted relative to the pulley 32, the pulley 100 will be moved away from the pulley 34 against the action of the spring means 122 as the stack of notes 24 passes between the pulleys 100 and 34, and the pulley 68 will be moved away from the pulley 32 against the action of the spring means 77 (FIG. 2) as the stack passes between the pulleys 68 and 32.

The note stacking and presenting mechanism 10 described above has the advantages that it is fast and reliable in operation and that no problems due to possible generation of static are encountered. Also, the cash dispenser unit 224 described above in relation to a through-the-wall ATM has the advantage that the note reject hopper 78 and the currency cassettes 232 are conveniently positioned for servicing from the rear of the safe 226.

What is claimed is:

1. A sheet handling apparatus comprising:

rotatable cylindrical means;

endless belt means arranged to be in cooperative relationship with said cylindrical means over a major part of the periphery of said cylindrical means;

feeding means for feeding both single and multiple sheets from sheet supply means into an entry throat between said belt means and the periphery of said cylindrical means;

drive means, operable in a first mode or a second mode, for driving said belt means and said cylindrical means so that the parts of said belt means and said cylindrical means which are in cooperative relationship with each other move in the same direction, whereby either a single or multiple sheet fed into said entry throat when said drive means is operating in said first mode is carried around the axis of said cylindrical means while held between said belt means and said cylindrical means, the operation of said feeding means being synchronized with the rotation of said cylindrical means so that each successive single or multiple sheet fed into said entry throat while said drive means is operating in said first mode is brought into a superposed relationship with the sheet or sheets already held between said belt means and said cylindrical means so as to form a stack of sheets between said belt means and said cylindrical means;

control means for changing the mode of operation of said drive means, whereby, when said drive means changes from said first mode to said second mode of operation, the movement of said belt means and said cylindrical means is reversed so as to drive said stack out of said entry throat; and movable guide means associated with said feeding means and being arranged to diver alternate sheets fed from said sheet supply means around a diversion path whereby said alternate sheets are delayed by an amount corresponding to half the time taken for said cylindrical means to complete one revolution.

2. An apparatus according to claim 1, in which said diversion path is defined by further rotatable cylindrical means and further endless belt means arranged to be in cooperative relationship with said further cylindrical means over a major part of the periphery of said further cylindrical means, each of said alternate sheets being carried around said diversion path while held between said further belt means and said further cylindrical means.

3. A sheet handling apparatus comprising:

rotatable cylindrical means;

endless belt means arranged to be in cooperative relationship with said cylindrical means over a major part of the periphery of said cylindrical means;

feeding means for feeding sheets from sheet supply means into an entry throat between said belt means and the periphery of said cylindrical means;

drive means, operable in a first mode or a second mode, for driving said belt means and said cylindrical means so that the parts of said belt means and said cylindrical means which are in cooperative relationship with each other move in the same direction, whereby a single or multiple sheet fed into said entry throat when said drive means is operating in said first mode is carried around the axis of said cylindrical means while held between said belt means and said cylindrical means, the operation of said feeding means being synchronized with the rotation of said cylindrical means so that each successive single or multiple sheet fed into said entry throat while said drive means is operating in said first mode is brought into a superposed relationship with the sheet or sheets already held between said belt means and said cylindrical means so as to form a stack of sheets between said belt means and said cylindrical means; and control means for changing the mode of operation of said drive, whereby, when said drive means changes from said first mode to said second mode of operation, the movement of said belt means and said cylindrical means is reversed so as to drive said stack out of said entry throat; movable guide means associated with said cylindrical means and movable between a first position and a second position, said guide means being arranged to be in said first position in which said guide means guides sheets around the axis of said cylindrical means when said drive means is operating in said first mode, and being arranged to be in said second position in which said guide means guides said stack of notes out of said entry throat and away from said cylindrical means when said drive means is operating in said second mode; and said endless belt means being guided around a series of pulley means including first pulley means and second pulley means, each of said first and second pulley means being resiliently mounted relative to said cylindrical means so as to be urged towards said cylindrical means, said series of pulley means including third pulley means and fourth pulley means, said first pulley means being carried on first support means pivotally mounted on a first shaft on which said third pulley means is mounted, and said second pulley means being carried on second support means pivotally mounted on a second shaft on which said fourth pulley means is mounted.

* * * * *

UNITED STATES PATENT AND TRADEMARK OFFICE

CERTIFICATE OF CORRECTION

PATENT NO. : 4,822,018

DATED : April 18, 1989

INVENTOR(S) : David A. Hain

It is certified that error appears in the above-identified patent and that said Letters Patent is hereby corrected as shown below:

Column 11, line 65, delete "diver" and substitute --divert--.

Column 12, line 40, after the word "drive" (first occurrence), insert --means--.

Signed and Sealed this

Thirtieth Day of April, 1991

*Attest:*

*Attesting Officer*

HARRY F. MANBECK, JR.

*Commissioner of Patents and Trademarks*